US010828546B2

(12) United States Patent
Park

(10) Patent No.: US 10,828,546 B2
(45) Date of Patent: Nov. 10, 2020

(54) GOLF SWING PRACTICE MAT FOR STRENGTHENING SWING AND INCREASING CLUB HEAD SPEED

(71) Applicant: Smart Body LLC, West Warwick, RI (US)

(72) Inventor: Othili Park, West Warwick, RI (US)

(73) Assignee: Smart Body, LLC, West Warwick, RI (US)

( * ) Notice: Subject to any disclaimer, the term of this patent is extended or adjusted under 35 U.S.C. 154(b) by 0 days.

(21) Appl. No.: 16/161,325

(22) Filed: Oct. 16, 2018

(65) Prior Publication Data

US 2019/0374836 A1 Dec. 12, 2019

Related U.S. Application Data

(60) Provisional application No. 62/681,650, filed on Jun. 6, 2018.

(51) Int. Cl.
*A63B 69/36* (2006.01)

(52) U.S. Cl.
CPC .. *A63B 69/3661* (2013.01); *A63B 2069/3664* (2013.01)

(58) Field of Classification Search
CPC ..... A63B 69/3661; A63B 2069/3664
See application file for complete search history.

(56) References Cited

U.S. PATENT DOCUMENTS

| | | | | | |
|---|---|---|---|---|---|
| 3,139,283 | A * | 6/1964 | Lester | A63B 69/3661 | 473/278 |
| 3,323,802 | A * | 6/1967 | Riner | A63B 69/3661 | 473/159 |
| 3,414,266 | A * | 12/1968 | Mitchell | A63B 69/3661 | 473/278 |
| 3,565,742 | A * | 2/1971 | Stephens et al. | A63B 69/3661 | 428/356 |
| 4,294,450 | A * | 10/1981 | Gallic | A63B 69/3661 | 473/159 |
| 4,311,312 | A * | 1/1982 | O'Brien | A63B 69/3661 | 473/218 |
| 4,387,896 | A * | 6/1983 | O'Brien | A63B 69/3661 | 473/218 |
| 5,356,147 | A | 10/1994 | MacDonald | | |
| 6,994,634 | B1 | 2/2006 | McFarlin et al. | | |
| 7,384,346 | B2 | 6/2008 | McFarlin et al. | | |
| 9,561,422 | B1 * | 2/2017 | Csencsits | A63B 69/3661 | |
| 2001/0003104 | A1 * | 6/2001 | Binduga | A63B 69/3623 | 473/221 |

(Continued)

*Primary Examiner* — Raleigh W Chiu
(74) *Attorney, Agent, or Firm* — Barlow, Josephs & Holmes, Ltd.

(57) ABSTRACT

A golf swing practice mat including a ball practice area and a resistance area is disclosed to provide a physical resistance to the club head at the time of ball impact and through the follow through. In one embodiment, the golf mat comprises a generally rectangular rubber base and a simulated grass material overlying the rubber base. The simulated grass upper layer may be a typical fairway length simulated grass. The mat has a central ball placement area which may include a tee and a resistance area in front of the ball placement area, i.e. in the follow-through area immediately after striking the ball. The spacing of the resistance area from the ball placement area, and or tee may be variable.

16 Claims, 10 Drawing Sheets

(56) References Cited

U.S. PATENT DOCUMENTS

| | | | | |
|---|---|---|---|---|
| 2004/0142758 | A1* | 7/2004 | Shioda | A63B 69/3661 473/278 |
| 2005/0009645 | A1* | 1/2005 | Isabell | A63B 69/3694 473/400 |
| 2005/0049069 | A1* | 3/2005 | Speck | A63B 69/3661 473/278 |
| 2005/0277489 | A1 | 12/2005 | Choe | |
| 2006/0019764 | A1 | 1/2006 | Gegelys | |
| 2007/0099717 | A1* | 5/2007 | McFarlin | A63B 69/3661 473/278 |
| 2007/0293338 | A1* | 12/2007 | McFarlin | A63B 69/3623 473/278 |
| 2012/0178546 | A1* | 7/2012 | Park | A63B 69/3661 473/278 |
| 2013/0288814 | A1* | 10/2013 | Holland | A63B 69/3623 473/278 |
| 2017/0296898 | A1* | 10/2017 | Brosseau, Jr. | A63B 69/3661 |

* cited by examiner

GOLF SWING PRACTICE MAT FOR STRENGTHENING SWING AND INCREASING CLUB HEAD SPEED

CROSS-REFERENCE TO RELATED APPLICATIONS

This application claims benefit to U.S. Provisional Application No. 62/681,650, filed on Jun. 6, 2018, titled "GOLF SWING PRACTICE MAT FOR STRENGTHENING SWING AND INCREASING CLUB HEAD SPEED," hereby incorporated by reference in its entirety.

BACKGROUND OF THE INVENTION

(1) Field of the Invention

The instant invention relates to golf swing practice devices and more particularly to a novel practice mat structure with flexible resistance fingers which help strengthen the golfer's swing and increase club head speed through the ball.

(2) Description of Related Art

Most golf practice mats have a simulated grass material which simulates the grass length on a regular fairway of a golf course so that players may practice hitting the ball from a surface that somewhat simulates real life conditions. While these mats are effective for simulating the feel of hitting a golf ball they do not provide any type of muscle strengthening effect which is critical for new golfers. The ability of a golfer to generate high club head speed through impact is critical to ball fight and accuracy. Moreover, the muscles required for a strong swing are many and varied and cannot generally be isolated with traditional exercises. There are currently no products available which are directed towards strengthening the specific muscle groups used for creating the strongest impulse in golf and impact training to hit with a clear focused objective.

Therefore, there remains a need in the art for devices and methods which provide for improved targeted muscle strengthening while simultaneously practicing traditional golf skills.

SUMMARY OF THE INVENTION

The present invention provides a novel golf practice mat which is intended to provide a physical resistance to the club head at the time of ball impact and through the follow through. In one embodiment, the golf mat comprises a generally rectangular rubber base and a simulated grass material overlying the rubber base. The simulated grass upper layer may be a typical fairway length simulated grass, or turf. The mat has a central ball placement area which may include a tee and a resistance area in front of the ball placement area, i.e. in the follow-through area immediately after striking the ball. The spacing of the resistance area from the ball placement area, and or tee may be variable.

The resistance area can be provided with a plurality of vertically disposed resistance fingers extending upwardly from the mat in a predetermined pattern, which may be a regularly spaced pattern or may be a random pattern. The rubber fingers may be hollow rubber tubing or solid rubber, or any other type of durable elastomeric material. The height and diameter of the fingers may vary according to the degree of resistance being provided. In some embodiments, the area of the rubber fingers can be user replaceable to vary the amount of resistance provided as the user increases their overall strength.

In some embodiments, the rubber fingers may comprise a base flange portion and a finger portion which extends from the flange. In this manner, the fingers may extend through holes in the mat and be at least partially supported by the thickness of the mat. The resistance fingers may also be selectively removed to increase or decrease resistance as desired. Furthermore, this arrangement also allows the fingers to be replaced, if needed.

In use, the mat may initially be used without actually hitting a ball whereby the user will simply swing the club through the resistance fingers to strengthen the users swing through the impact area. Alternatively, the user may actually hit the ball during use of the improved mat. As the user progresses in skill and strength, the user may increase the number of resistance fingers, and then graduate to placing a golf ball on the central tee and attempting to hit through the ball and through the resistance fingers. The result is strengthened muscles needed to generate proper club head speed through impact and follow through and a strong swing.

BRIEF DESCRIPTION OF THE DRAWINGS

While the specification concludes with claims particularly pointing out and distinctly claiming particular embodiments of the instant invention, various embodiments of the invention can be more readily understood and appreciated from the following descriptions of various embodiments of the invention when read in conjunction with the accompanying drawings in which:

DETAILED DESCRIPTION OF THE INVENTION

Figure 1:
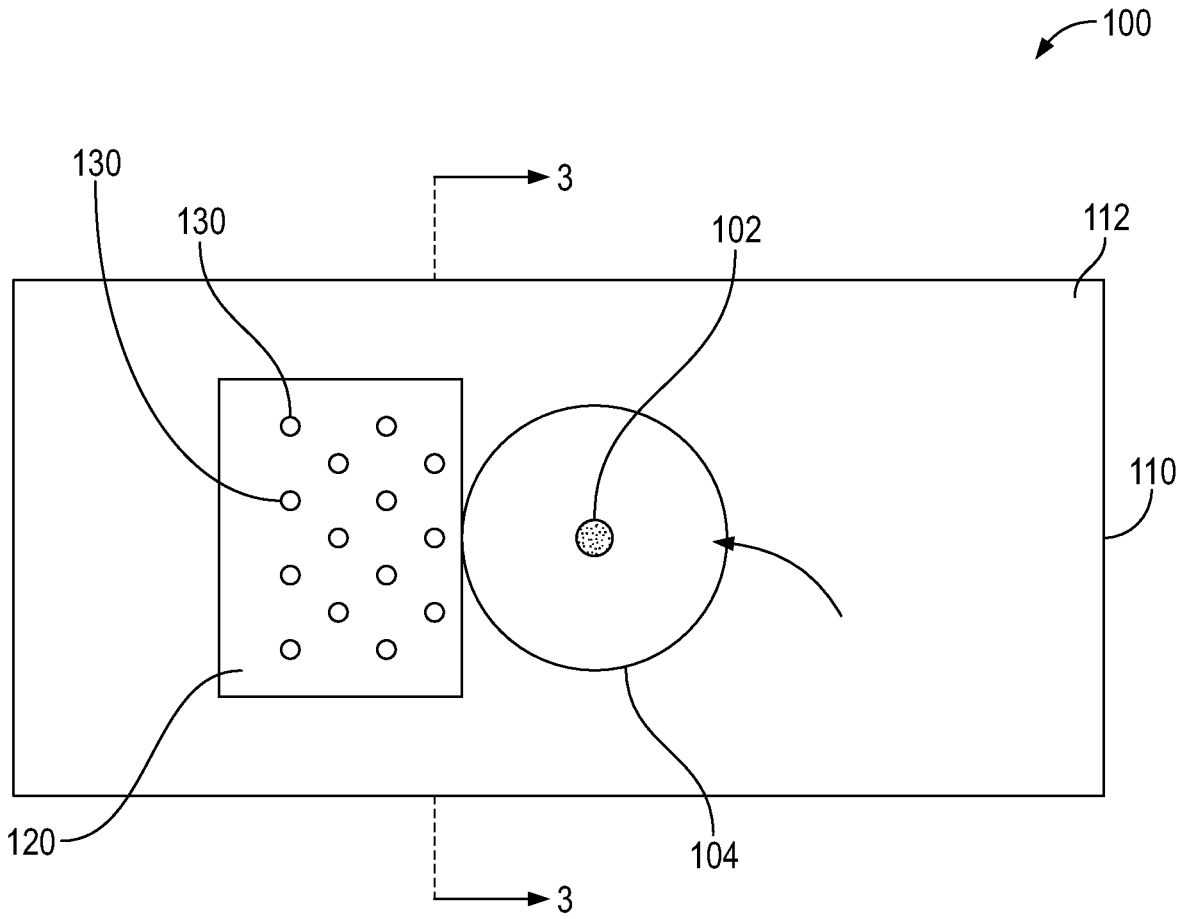
FIG. 1 is a plan view of an exemplary embodiment of the golf practice mat of the present invention with the mat and resistance fingers oriented to provide resistance on the follow through after ball impact.

Certain exemplary embodiments will now be described to provide an overall understanding of the principles of the structure, function, manufacture, and use of the device and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present disclosure. Further, in the present disclosure, like-numbered components of the embodiments generally have similar features, and thus within a particular embodiment each feature of each like-numbered component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape. Further, to the extent that directional terms like top, bottom, up, or down are used, they are not intended to limit the systems, devices, and methods disclosed herein. A person skilled in the art will recognize that these terms are merely relative to the system and device being discussed and are not universal.

Referring now to the drawings, the present invention provides a golf practice mat that advantageously provides a physical resistance to the club head just after the time of ball impact through the follow through. This resistance provides the added benefit of aiding the user in increasing the strength of specific muscle groups which are used when driving a golf ball. This added strength can translate into longer drive distances of a golf ball during actual game play.

Figure 2:
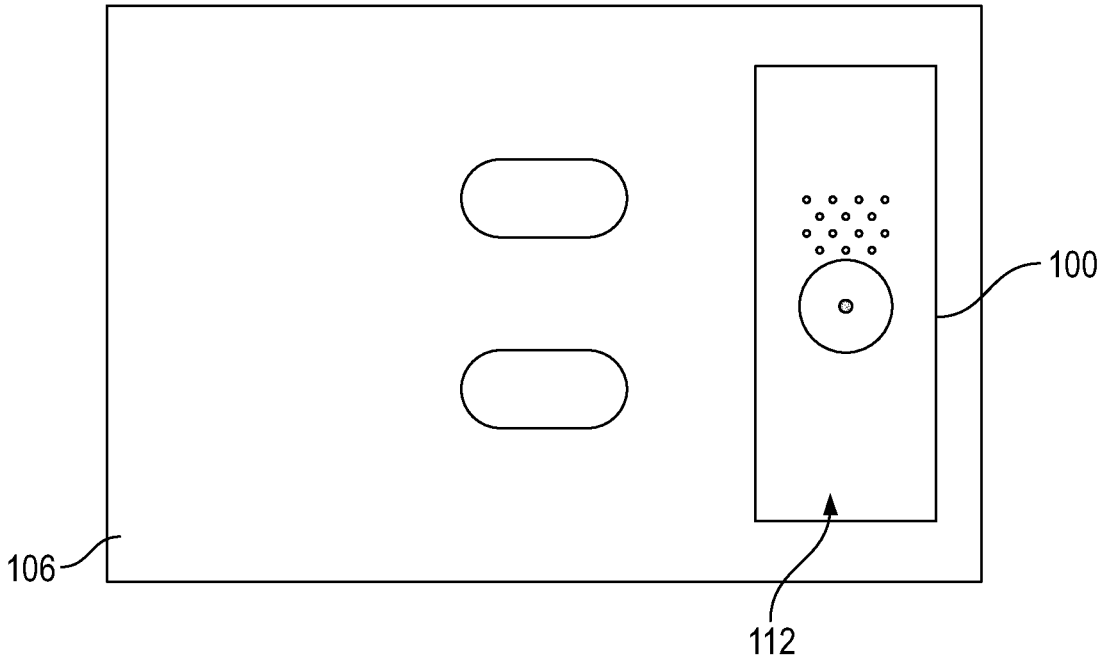
FIG. 2 is a plan view of yet another exemplary embodiment with the mat installed as an insert within a larger practice mat.

As shown in FIG. 1, the practice mat 100 can generally include a rectangular rubber base 110 and a simulated grass material 112 overlying the rubber base. While a rubber base is described with regards to FIG. 1, other base materials can be used, including fabrics, wood, plastics, or other resilient materials. The outer shape and dimensions of the base 110 are not critical to the invention, but due to the elongated swing path of a golf club 140, a rectangular shape tends to be the most practical shape. Alternatively, the base 110 can have any shape which may best fit into the environment which it will be used, e.g. triangular, square, circular, oval, etc. The simulated grass 112 of the upper layer may be a typical fairway length grass or can be of any desired length. As discussed further below, the mat 100 may be an insert disposed in a larger practice mat 106, as shown in FIG. 2.

Referring to FIG. 1, the mat 100 can have a central ball placement area 104 surrounding the ball 102 and resistance area(s) 120. The central ball placement area 104 may include a removable rubber tee 103. The resistance area 120 is preferably located immediately in front the ball placement area 104, i.e. in the follow through area immediately after striking the ball 102. In alternative embodiments, the resistance area 120 may be located in other areas of the mat 100 to target other muscle groups. The spacing of the resistance area 120 from the ball placement area 104, and or tee 103 may be variable according to the need and desired resistance effect, as discussed further below.

Figure 3:
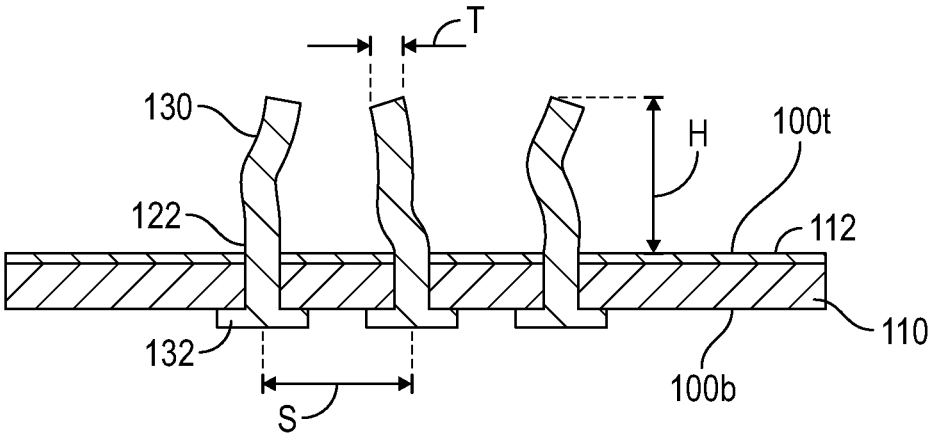
FIG. 3 is a cross-sectional view of the mat taken along line 3-3 of FIG. 1.

The resistance area 120 is provided with a plurality of vertically disposed rubber fingers, or resistance fingers, 130, extending upwardly from the mat 100 in a predetermined pattern. The pattern may be a regularly spaced pattern, such as an array, with each finger 130 being spaced by a distance "S" or it may be a random pattern with varying spaces between the finger 130. The fingers 130 may comprise hollow tubing or solid rubber, or any other type of durable elastomeric material which can withstand repeated impacts from a golf club such as an iron or a wood. The height "H" and diameter "T" of the fingers, as shown in FIG. 3, may vary according to the degree of resistance being provided. It is noted however, that the size and spacing of the fingers 130 is not intended to resemble actual grass in this embodiment. Rather the fingers are significantly larger and more widely spaced than the artificial turf 112, or "grass," as is apparent from FIG. 3. For example, the finger can have a height "H" in the range of approximately 2 inches-20 inches and a diameter "T" in the range of approximately ⅛ inches-1 inch. The resistive force of the fingers can be a function of the number of fingers used, the height of the fingers, and the diameter of the fingers. Additionally, the resistive force can also be a function of the material used and the cross-sectional shape of the fingers.

Referring to FIG. 3, in some embodiments, the rubber fingers may comprise a base flange portion 132 and a finger portion 130 which extends upward from the flange 132. In the illustrated embodiment, the fingers 130 have a circular cross-sectional shape, with or without a central lumen. In this regard, the fingers 130 may extend through holes 122 in the mat 100 and be at least partially supported by the thickness of the mat 100. The through holes 122 can extend all the way through the mat 100 from a top side **100*t*, including any artificial turf, to a bottom side 100*b*. The fingers 130 may also able to be selectively removed through the holes 122 to increase or decrease resistance as desired. Furthermore, this arrangement also allows the fingers 130 to be replaced, if needed. In other embodiments, the fingers 130 may be imbedded directly into the mat 100 or secured to the surface by various means. In some embodiments, the fingers 130** can be formed from any suitable material including flexible plastics, rigid plastics, metals, etc and can have any suitable cross-sectional shape.

Figure 5:
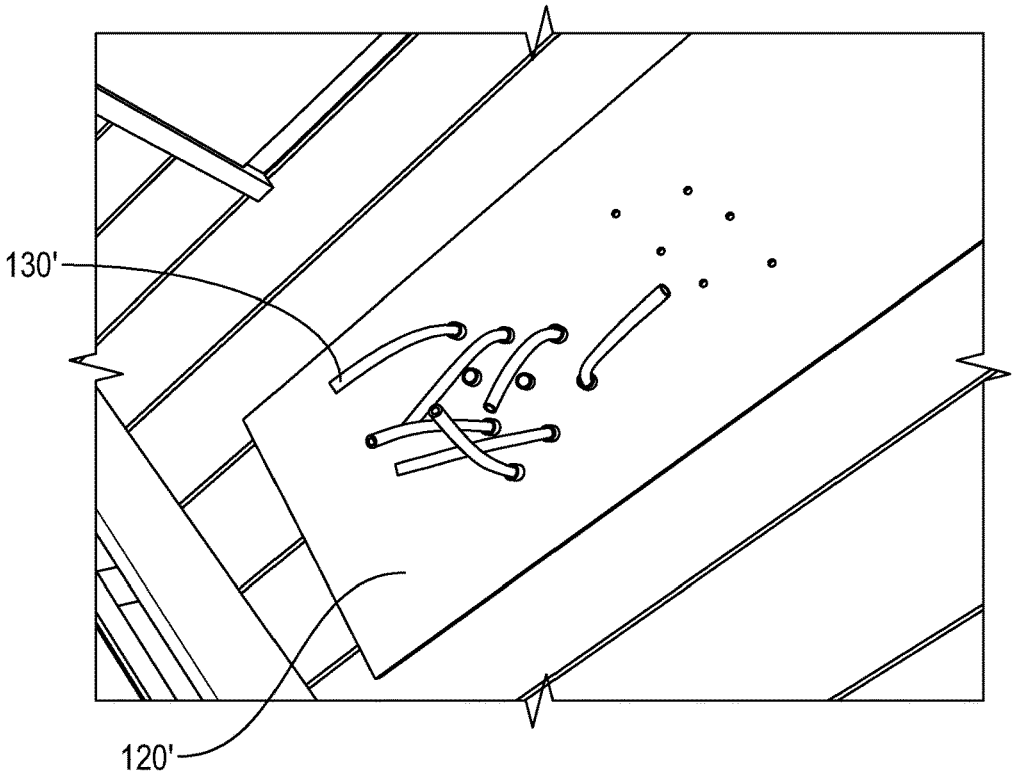
FIG. 5 is a top view of an exemplary embodiment of a practice mat.
Figure 6:
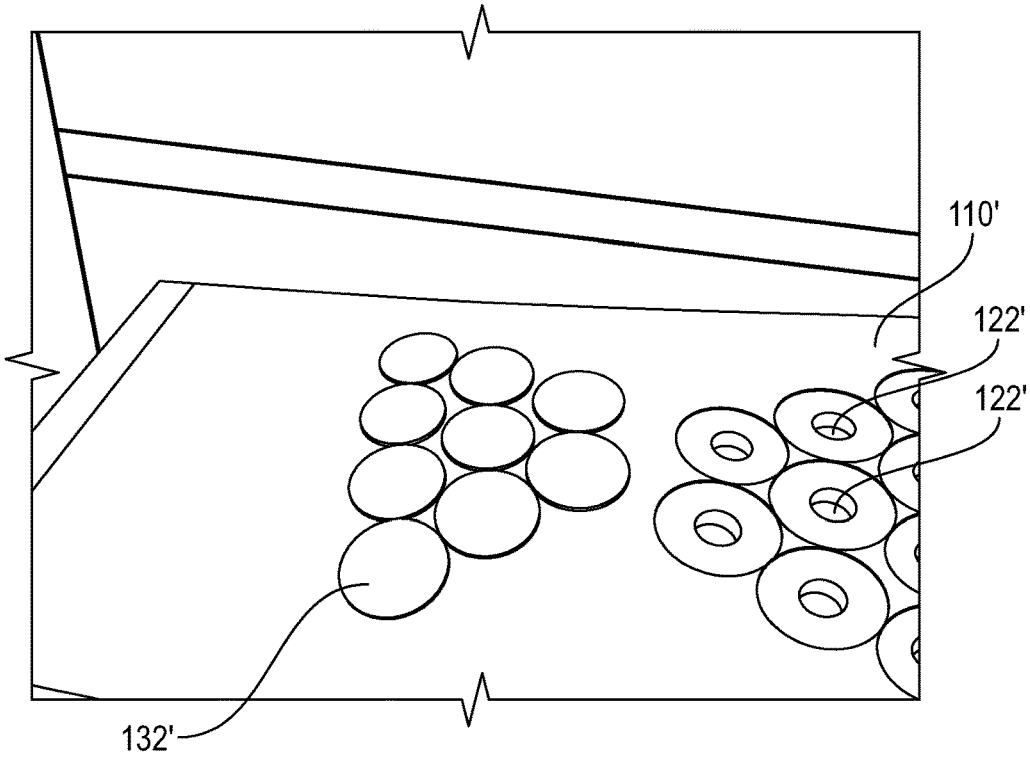
FIG. 6 is a bottom view of the exemplary embodiment of FIG. 5.
Figure 7:
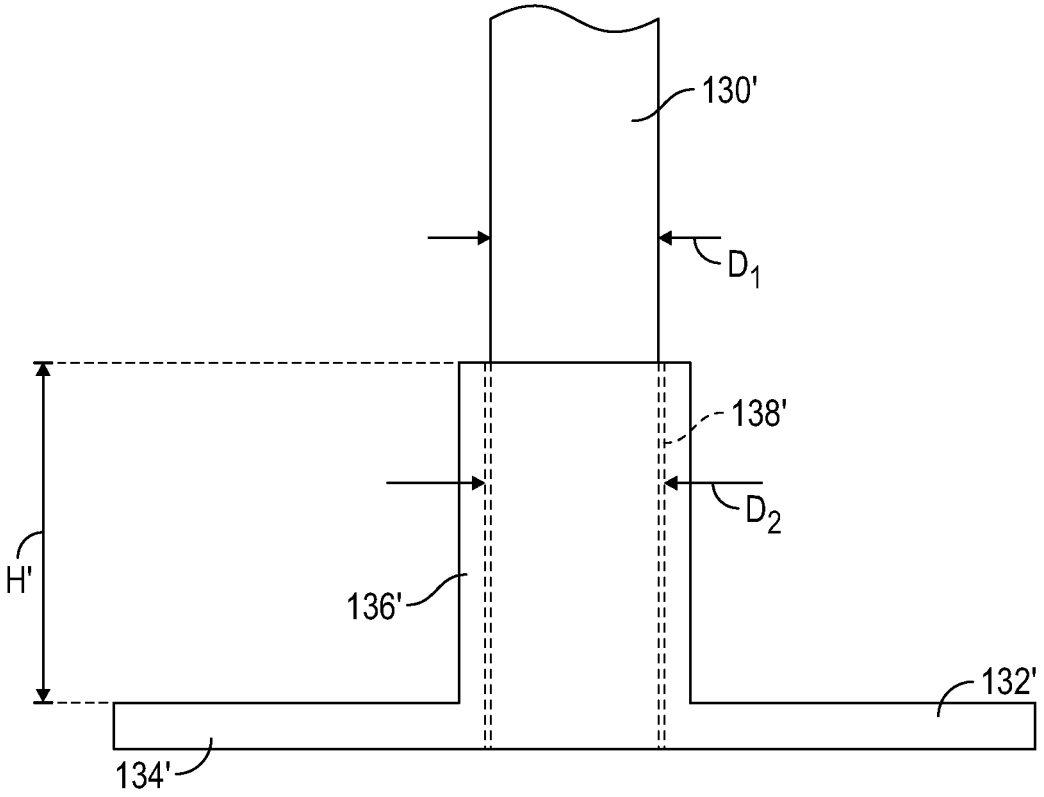
FIG. 7 is a partial side view of a resistance finger of the embodiment of FIG. 5.

In some embodiments, as shown in FIGS. 5-7, the fingers 130' may include a tubular base 132', or flange, portion which extends through the mat 100'. In some embodiments, the base 132' can be a rigid plastic material and the finger 130' can be a flexible rubber material. Alternatively, the base 132' and the finger 130' can be the same material or any of the aforementioned material noted above. For example, the finger base 132' flange can include a first lower flange portion 134' and a tubular extension 136' extending upward from the flange 134'. The lower flange portion 134' can be generally circular having a substantially larger diameter than the finger 130' and the tubular extension 136'. The tubular extension 136' can have a height H' which is substantially the same as the thickness of the practice mat 100'. The base 132' can include an inner lumen 138' extending therethrough having an inner diameter $D_2$ which is larger than the diameter $D_1$ of the finger portion 130' such that the finger portion 130' can extend therethrough. Further, the extension 136' can have an outer diameter $D_3$ that is substantially the same or less than the diameter of a through-hole in the resistance area 120' of the mat 100'.

Figure 8:
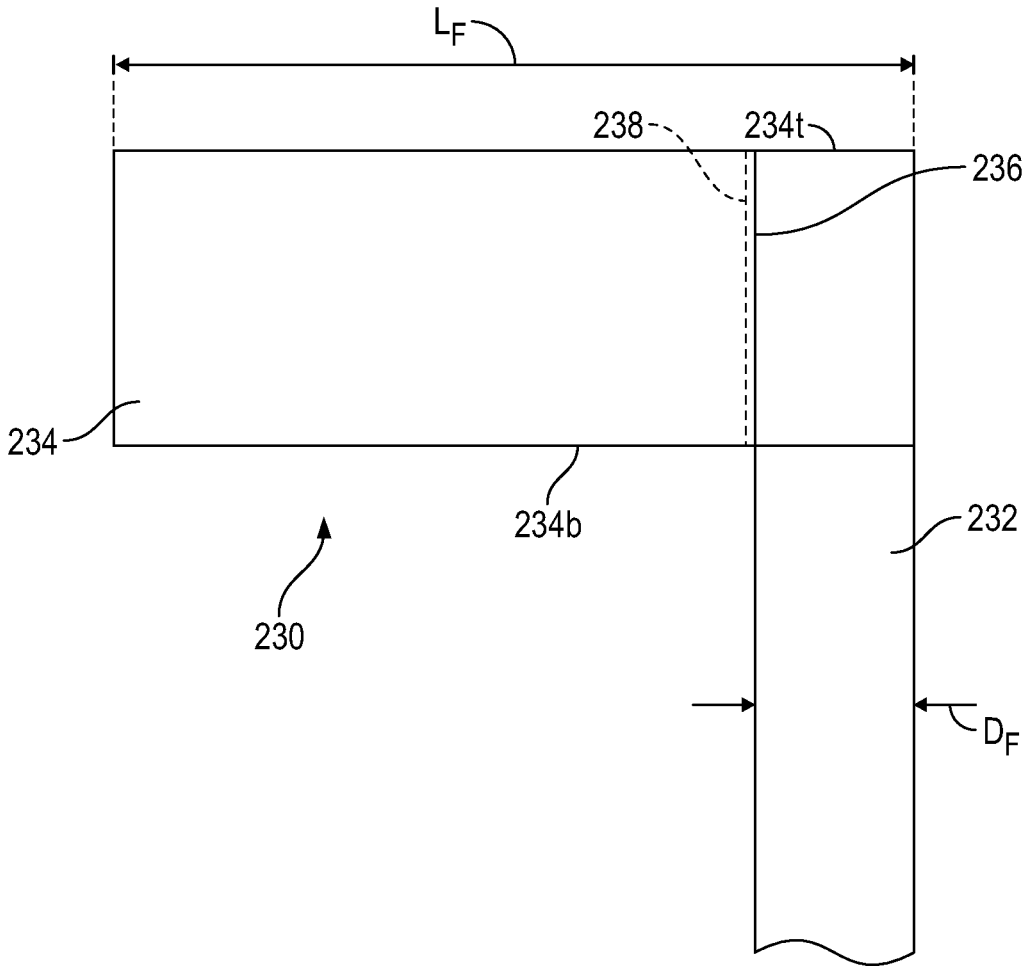
FIG. 8 is a partial side view of an alternative resistance finger.
Figure 9:
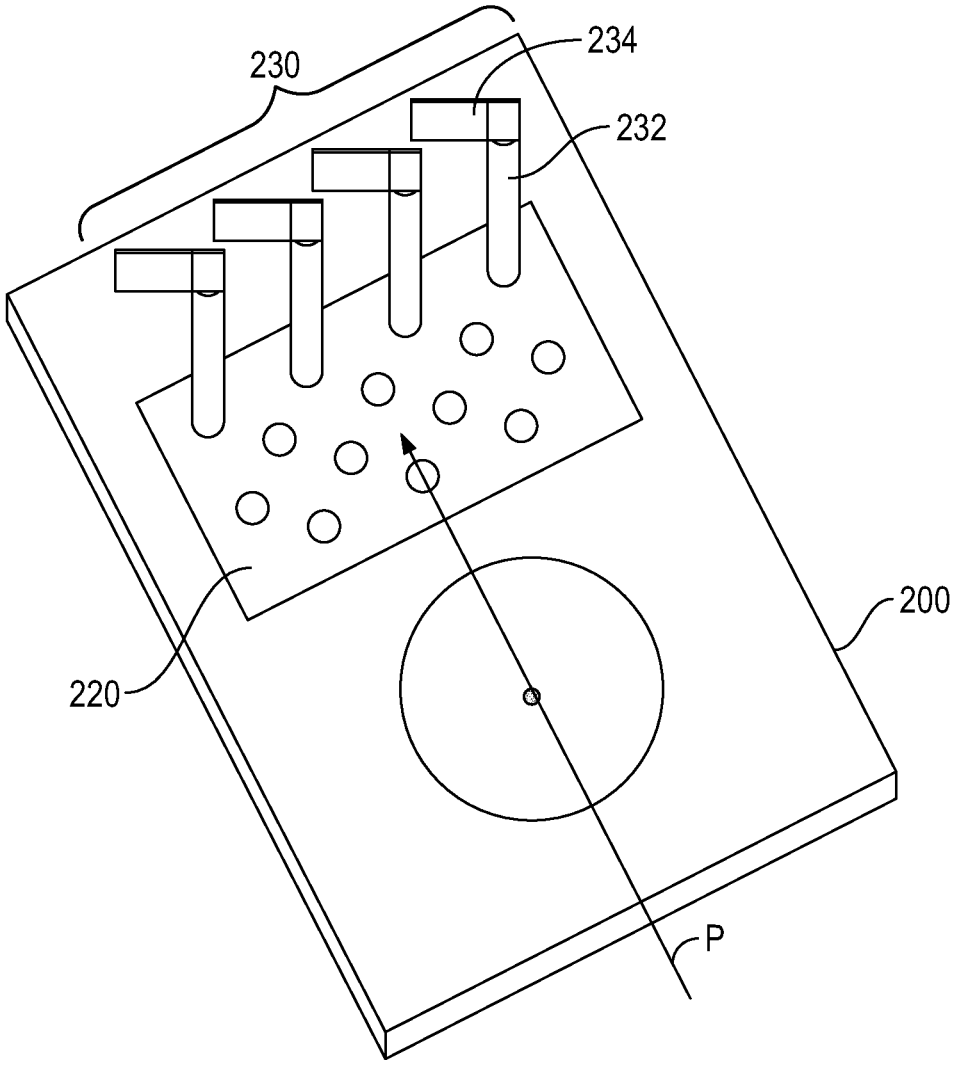
FIG. 9 is a perspective view of a mat including the alternative resistance finger of FIG. 8.
Figure 10:
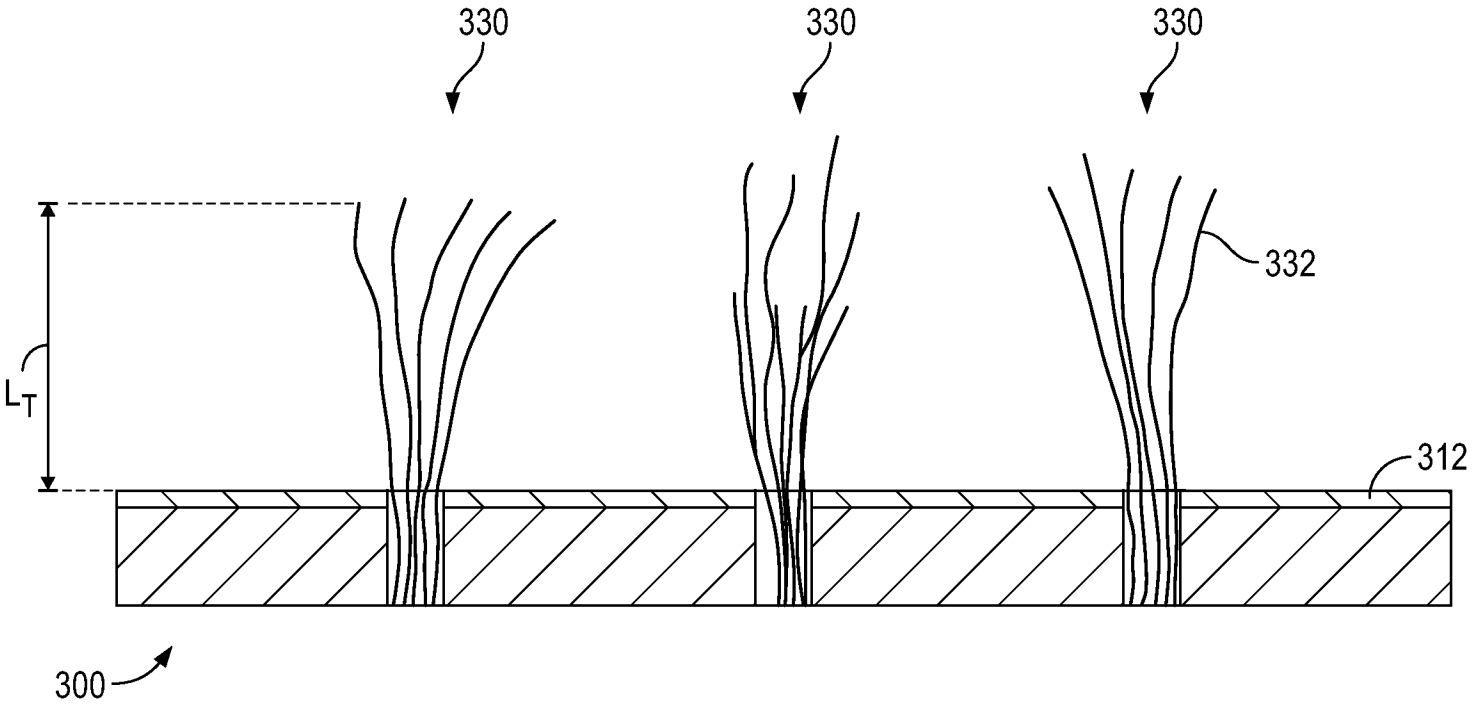
FIG. 10 is a partial cross-sectional view of a mat with a further alternative resistance fingers.

In some alternative embodiments, the fingers 230 can include an upright finger portion 232 and a flag, or flap, 234 on the upper end of some, or all, or the fingers 230. As shown in FIG. 8, the alternative finger 230 can have a flag portion 234 disposed on the upper end of the finger 230. In some embodiments, the flag portion 234 can have a generally rectangular shape with a lumen 236 extending from a top edge 234*t* to a bottom edge 234*b* of the flag. The lumen 236 can be formed by punching a hole from the top edge to the bottom edge. Alternatively, as shown in at least FIG. 8, the lumen 236 can be formed by wrapping a proximal portion of the flag around the finger. The wrapped around portion can be fixed to the remainder of the flag by stitching, adhesive, tape, or other mechanical or chemical means 238. In an alternative embodiment, the flag can have any shape, e.g., circular, oval, triangular, square, etc. shape. The lumen 236 can have a diameter that is sized to receive the finger with a diameter $D_F$. Alternatively, the flag 234 can be affixed to the finger by means of an adhesive, tape, or other mechanical or chemical fixation means. In a further alternative, the finger 232 and the flag 234 can be formed from a unitary piece of material. As shown in FIG. 9, a mat 200 can include a plurality of flags 230 which can be oriented such that they face the same direction in the drive path of a golf club. The flags 230 can be oriented such that they extend perpendicular to the drive path P. In some embodiments, the flags 230 can be oriented at other angles to vary the resistance that they offer the user. Alternatively, the flags 230 can be all oriented in the opposite directions or can be reoriented by the user themselves.

In some embodiments, the fingers 330 can alternatively be made of a plurality of individual groups, or tufts, of artificial turf 332 each of which has a greater length $L_T$ than the artificial turf 312 of the remainder of the mat 300. The individual blades of turf of the group can have the same length, or a plurality of lengths.

Figure 4:
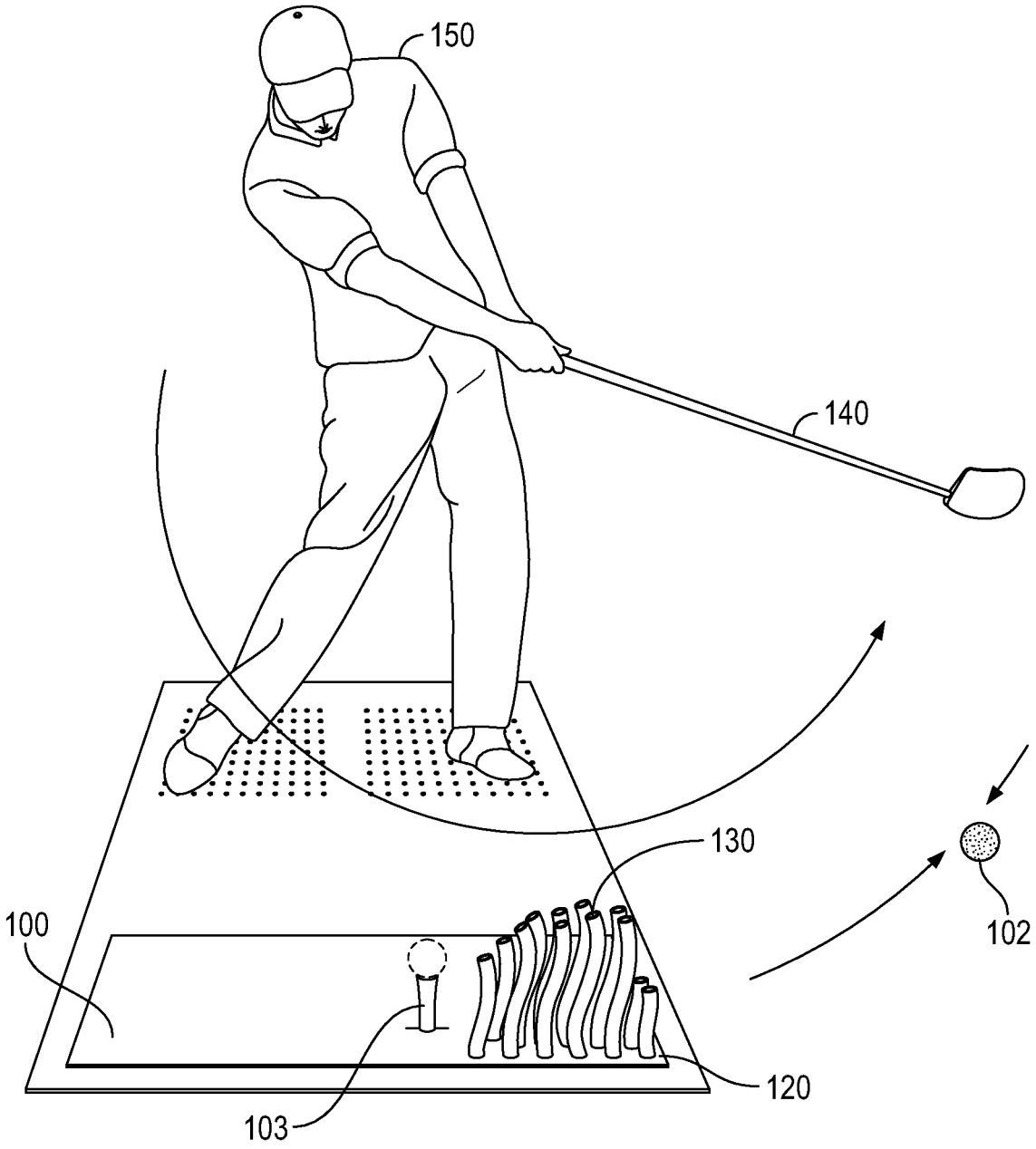
FIG. 4 is an environmental view illustrating a golfer using the mat.

Referring to FIGS. 2 and 4, the present practice mat 100 may be appropriately sized so that it can be incorporated into a larger base mat 106 which the user 150 may stand on (See FIG. 4). Alternatively, the practice 100 mat can be placed on any suitable surface and used without a larger base mat 106.

In use, as shown for example in FIG. 4, the mat 100 may initially be used without actually hitting a ball 102 whereby the user 150 repeatedly swings the club 140 through the resistance fingers 130 to strengthen the user's swing through the impact area 120 and follow through. The club 140 can be a bamboo practice club or a driver intended for use while playing. Initially, the user 150 may employ only a few resistance fingers 130. As the user 150 progresses in skill and strength, the user 150 may increase the number of resistance fingers 130 in front of the ball 102, and then graduate to placing a golf ball 102 on the central tee 103 and attempting to hit through the resistance fingers 130 and through the ball. The result of use of the mat 100 is that the user strengthens muscles needed to generate proper club head speed through impact and a strong swing.

Figure 11:
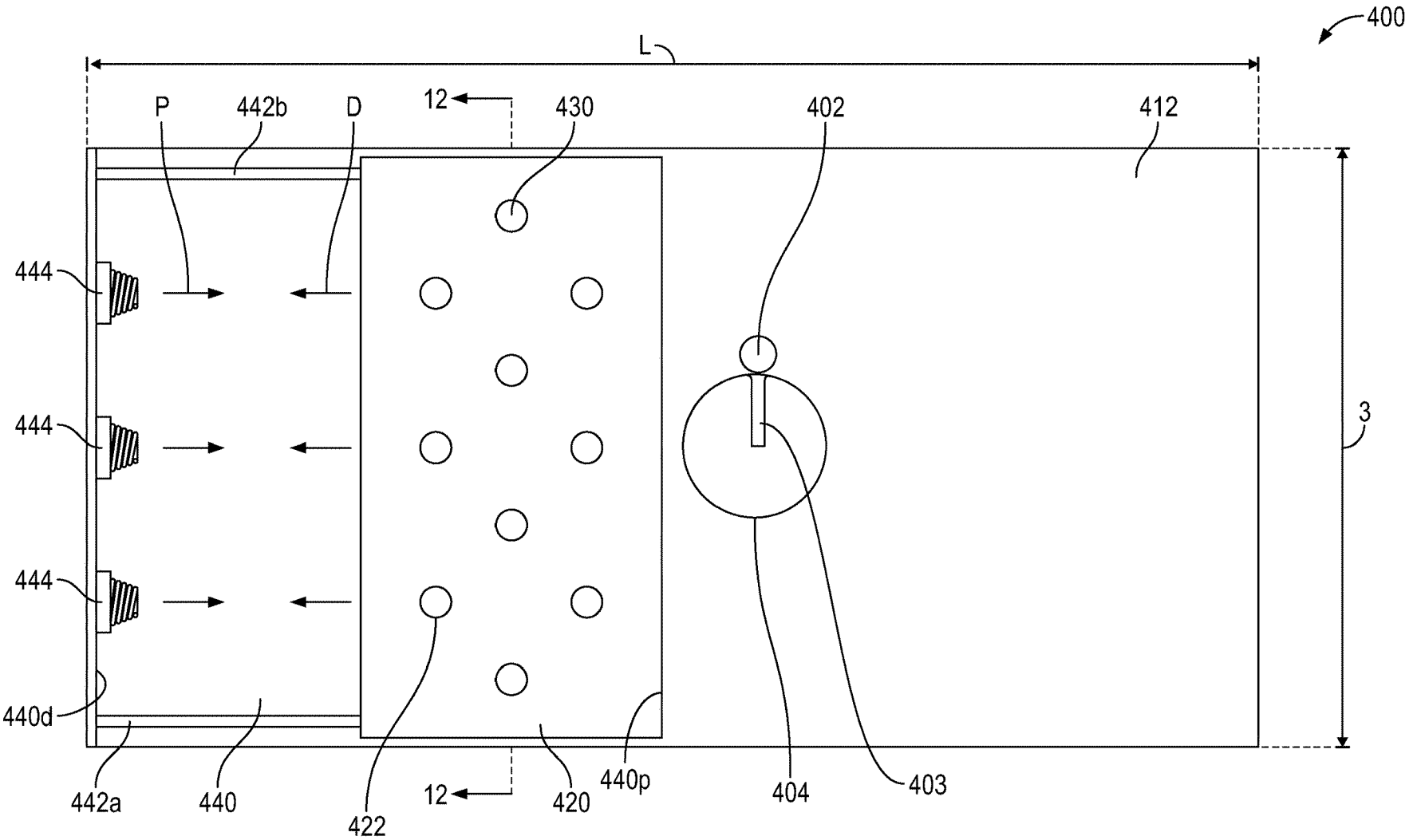
FIG. 11 is a top view of another exemplary embodiment of a mat with a moveable resistance area.
Figure 12:
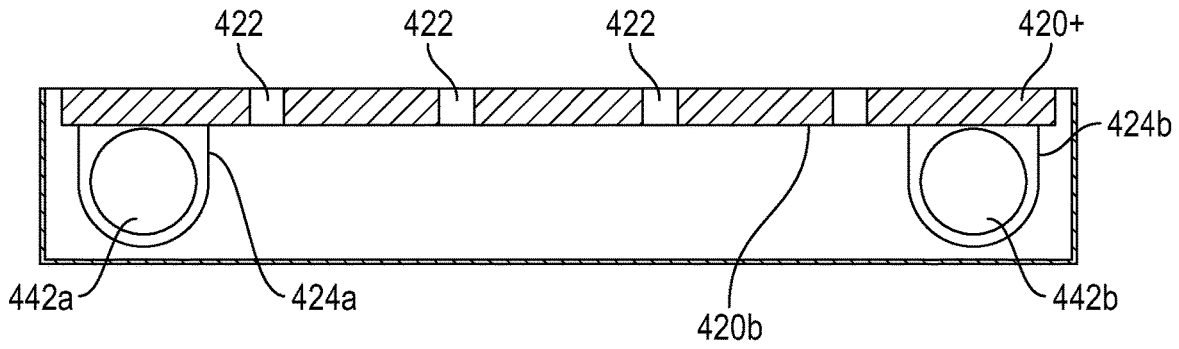
FIG. 12 is a cross-sectional view of the mat of FIG. 11 taken along line 12-12.
Figure 13:
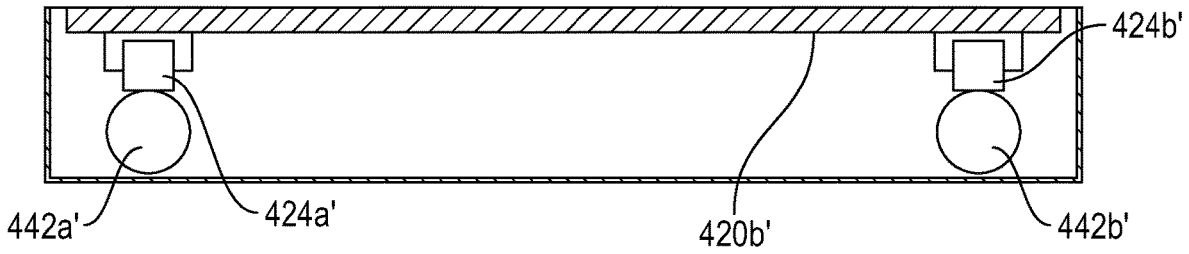
FIG. 13 is an alternative cross-sectional view of the mat of FIG. 11.

In an alternative embodiment, as shown in FIGS. 11-13, a mat 400 can be provided with a movable resistance pad. Advantageously, the movement of the movable resistance plate 420 can simulate the feel of a golfer's driver, or club, hitting a golf ball off a natural turf and taking a divot. Further, the movement of the resistance plate 420 can reduce the club head bounce to lessen stress on a user's joints thereby lessening the risk of injury.

The movable resistance pad 400 can generally have a width W and a length L. In the illustrated embodiment, the length L is greater than the width W. In a first central ball placement area 404 of the mat, the surface can be covered with simulated artificial grass 412 with a golf tee 403 at a central location. In an alternative embodiment, the tee 403 can be located in any suitable location. On the opposite end of the mat, a resistance area 420 can be disposed. In the alternative embodiment, the resistance area 420 can generally include a recessed area 440 having a height H having two offset rails 442*a*, 442*b* extending substantially parallel to one another and parallel to the length L of the mat. In some embodiments, the rails 442*a*, 442*b* can be coated in a grease, Teflon coating, or other materials to reduce any riding friction. A resistance plate 420 can be disposed on the rails 442*a*, 442*b* such that it can ride along the rails 442*a*, 442*b* in a substantially friction free manner from a proximal most location 440*p*, proximate the ball placement area 404, to a distal location proximate the distal end 440*d* of the recess 440. As shown, the upper surface 420*t* of the resistance plate 420 and the upper surface 412 of the central ball placement area can both be covered with real or artificial turf. Moreover, the upper surface of the resistance plate 420 and the upper surface 412 of the central ball placement area can be substantially co-planar. The top side 420*t* of the resistance plate 420 can be substantially similar to the resistance area of the prior embodiments. For example, the resistance plate 420 can include a plurality of through holes 422 each of which can receive any of the aforementioned types of resistance fingers or combinations thereof.

In some embodiments, the resistance plate 420 can have U-shaped brackets 424*a*, 424*b* extending from the underside 420*b* to secure the resistance plate to the rails 442*a*, 442*b*, as shown in FIG. 12. Alternatively, the resistance plate 420 can have a plurality of wheels 424*a*', 424*b*' disposed on the underside 420*b*' to roll along the rails 442*a*', 442*b*'. In either of the two alternatives, resistance to movement, of the plate 420, can be increased or decreased to facilitate different amounts of force required to move the plate 420. For example, if the resistance plate 420' includes wheels 424*a*', 424*b*', a variable break can be included to increase or decrease the amount of force needed to move the plate 420' towards the distal end of the mat during use. The force required to move the plate 420 be increased to further develop the targeted muscle groups needed to drive a golf ball accurately with increased distance.

At the distal end of the recess 440*d*, an array of springs 444 can be disposed along the distal wall of the mat facing the ball placement area. As shown in FIG. 12, the array can include three helical springs 444, however any number of springs can be included to allow the resistance plate 420 to "spring" or "bounce" back to a proximal location 440*p*. Alternatively, the springs can be any other springs. Further, in an alternative to springs, magnets can be used. For example, a first set of magnets can be disposed on the distal wall of the recess and a second set can be disposed on the distal end of the resistance plate. The two sets of magnets can have the same polarities facing each other, so that they would be repelled from one another. Advantageously, the springs 444 can provide a bias force to advance the resistance plate 420 back into an initial proximal location within the recess. [Question: Please let us know if there are any advantages to the configuration that we should include.]

In use, the mat 400 may initially be used without actually hitting a ball 402 whereby the user repeatedly swings the club through the resistance fingers 430 to strengthen the users swing through the impact area and follow through. As the user swings through the impact area 404 and follows through the resistance area 420, the resistance plate 420 will move distally towards the springs 444. The resistance plate 420 can advance distally D towards the springs and depress the springs such that they impart a force in the proximal direction P towards the proximal area of the recess 440. As above, initially, the user may employ only a few resistance fingers 430. As the user progresses in skill and strength, the user may increase the number of resistance fingers 430 in front of the ball, and then graduate to placing a golf ball 402 on the central tee 403 and attempting to hit through the resistance fingers 430 and through the ball 402. The user may opt to change the type of resistance fingers used or use a combination of different types of fingers. Further, a user may opt to change the resistance of the resistance plate 420 moving along the rails 442*a*, 442*b*. The result is strengthened muscles needed to generate proper club head speed through impact and a strong swing.

While there is shown and described herein certain specific structures embodying various embodiments of the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A golf swing practice mat comprising;

a ball placement area having a top surface at least partially covered in artificial turf; and a resistance area disposed adjacent to the ball placement area, said resistance area having a top surface at least partially covered with artificial turf, said resistance area disposed immediately forward of the ball placement area and defining a follow through area through which a club passes after striking a ball in the ball placement area, said resistance area further having a plurality of resistance fingers extending upward from the top surface of said resistance area a greater distance than the artificial turf, said plurality of resistance fingers being disposed immediately forward of the ball placement area, and wherein the top surface of the ball placement area is substantially co-planar with the top surface of the resistance area and wherein a club passing through the resistance area after striking the ball passes through said resistance fingers extending above the top surface of the resistance area and engages the plurality of resistance fingers such that forward movement of the club is resisted by the plurality of resistance fingers.

2. The golf swing practice mat of claim 1, wherein said plurality of resistance fingers comprise a plurality of closely spaced elongated rubber fingers having a height greater than the artificial turf.

3. The golf swing practice mat of claim 1, wherein at least one of the plurality of resistance fingers includes a flag portion extending substantially perpendicular to the resistance finger.

4. The golf swing practice mat of claim 1, wherein the resistance area includes a plurality of through holes extending from a bottom surface to the top surface of the resistance area and through the artificial turf, and wherein the plurality of resistance fingers extend through the plurality of through holes.

5. The golf swing practice mat of claim 2, wherein the resistance area includes a plurality of through holes extending from a bottom surface to the top surface of the resistance area and through the artificial turf, and wherein the plurality of resistance fingers extend through the plurality of through holes.

6. The golf swing practice mat of claim 5, wherein at least one of the plurality of resistance fingers comprise a flange base portion having a diameter greater than a diameter of the through hole, and a finger portion extending upward from the flange base portion having a diameter less than the diameter of the through hole.

7. A golf swing practice mat comprising:

a ball placement area having a top surface at least partially covered in artificial turf; and a resistance area disposed adjacent to the ball placement area having a top surface covering a first area with artificial turf and a second area having a plurality of resistance fingers extending upward from the top surface a greater distance than the artificial turf;

wherein the top surface of the ball placement area is substantially co-planar with the top surface of the resistance area, wherein the resistance area includes a plurality of through holes extending from a bottom surface to the top surface of the resistance area and through the artificial turf wherein at least one of the plurality of resistance fingers comprise a flange base portion having a diameter greater than a diameter of the through hole, and a finger portion extending upward from the flange base portion having a diameter less than the diameter of the through hole;

wherein at least one of the plurality of resistance fingers includes a lumen extending through the flange base portion;

wherein at least one of the plurality of resistance ringers includes a finger portion extending through both the lumen of the flange and the through hole.

8. The golf swing practice mat of claim 7, wherein the plurality of resistance fingers are rubber.

9. A golf swing practice mat comprising:

a ball placement area having a top surface at least partially covered in artificial turf; and a resistance area disposed adjacent to the ball placement area having a top surface covering a first area with artificial turf and a second area having a plurality of resistance fingers extending upward from the top surface a greater distance than the artificial turf, wherein the top surface of the ball placement area is substantially co-planar with the top surface of the resistance area, and said practice mat further comprising a recess disposed proximate to the ball placement area wherein the resistance area is moveably disposed in the recess.

10. The golf swing practice mat of claim 9, wherein the recess includes two parallel rails, and wherein the resistance area is slidably disposed on the rails.

11. The golf swing practice mat of claim 10, wherein the recess further includes at least one spring disposed in a travel path of the resistance area, wherein the resistance area is configured and arranged to advance from a first proximal location to a second distal location when struck by a golf club along the rails, and wherein the at least one spring is configured and arranged to actuate the resistance area from the second distal location to the first proximal location.

12. A golf swing practice mat comprising, a frame including a proximal ball placement area having a top surface at least partially covered in artificial turf;

a distal recess area having two rails extending longitudinally from a proximal end, proximate to the ball placement area, to a distal end; and a resistance mat slidably disposed in the distal recess, the resistance mat having a top surface at least partially covered with artificial turf and including a plurality of resistance fingers extending upward from the top surface of the resistance mat, wherein a top surface of the proximal ball placement area and the top surface of the resistance mat are co-planar, and wherein the resistance mat is configured to slide within the recess along the rails.

13. The golf swing practice mat of claim 12 further comprising an array of springs disposed at a distal end of the recess, wherein the array of springs is configured and arranged to actuate the resistance mat from the second distal location to the first proximal location.

14. The golf swing practice mat of claim 13, wherein the springs of the array of springs are helical springs.

15. The golf swing practice mat of claim 12, wherein the resistance mat further includes wheels disposed on the underside of the resistance mat, and wherein the wheels are configured and arranged to ride along the rails.

16. The golf swing practice mat of claim 12, wherein the resistance mat includes a plurality of U-shaped brackets disposed on the underside of the resistance mat, and wherein the rails of the recess extends through the plurality of U-shaped brackets.

* * * * *